US006070508A

United States Patent [19]

Grimme

[11] Patent Number: 6,070,508

[45] Date of Patent: Jun. 6, 2000

[54] APPARATUS AND METHODS FOR CUTTING A NOTCHED BODY OF DEFORMABLE MATERIAL

[75] Inventor: Hans Grimme, Scheppach, Germany

[73] Assignee: Hans Lingl Anlagenbau und Verfahrenstechnik GmbH & Co. KG, Neu-Ulm, Germany

[21] Appl. No.: 08/876,323

[22] Filed: Jun. 16, 1997

[30] Foreign Application Priority Data

Jun. 20, 1996 [DE] Germany ..... 196 24 584

[51] Int. Cl.[7] ..... B28B 11/14

[52] U.S. Cl. ..... 83/13; 83/155; 83/202; 83/651.1; 264/157

[58] Field of Search ..... 83/409, 425.2, 83/435, 435.2, 13, 17, 19, 415, 465, 466.1, 651.1, 807, 808, 33, 862, 401, 409.1, 202, 278, 282, 23, 155, 468.6, 917; 264/146, 157

[56] References Cited

U.S. PATENT DOCUMENTS

| | | | |
|---|---|---|---|
| 1,761,984 | 6/1930 | Frick | 83/409 |
| 2,864,412 | 12/1958 | Ponder | 83/409 X |
| 4,285,257 | 8/1981 | Eberle et al. | 83/33 X |
| 4,311,073 | 1/1982 | Brugger et al. | 83/23 |
| 4,709,609 | 12/1987 | Rautio | 83/409 X |

*Primary Examiner*—Clark F. Dexter
*Attorney, Agent, or Firm*—Nixon & Vanderhye

[57] ABSTRACT

In a process for cutting a deformable body, e.g., a clay column, into individual shaped bodies by using at least one cutting wire, the body is first provided with notches about its periphery by a known notching device. During the subsequent cutting, the body is supported by support strips that engage in the notches on both sides of the cut edges. The body is thus not deformed during cutting, no undesirable cutting edges are left and the notch definition remains.

8 Claims, 2 Drawing Sheets

APPARATUS AND METHODS FOR CUTTING A NOTCHED BODY OF DEFORMABLE MATERIAL

TECHNICAL FIELD

The invention relates to apparatus and methods for cutting a notched body of deformable material, such as a clay column, into individual shaped bodies using at least one cutting blade, e.g., a wire, whereby the material forming the body and the notch is substantially undisturbed after cutting. The process and the apparatus hereof are particularly useful to prevent deformations at the cut edge where a cutting wire leaves the clay column.

BACKGROUND

German Patent 33 06 852 C1 discloses a device for notching and cutting shaped bodies from an extruded section of material. The material is notched about its periphery and transported into a cutting position having parallel conveyor belts arranged such that the notches register between the conveyor belts. A cutting wire passes through the material at a location in registration with the space between the conveyor belts.

A disadvantage of that device resides in the fact that the cutting wire, which is moved downwardly through the extruded piece, displaces deform able material of the body, e.g., clay, in the direction of the lower cutting edge, so that the notch is deformed, smeared over and a beard is produced. In short, the notch definition is substantially distorted and destroyed. This is not only aesthetically unacceptable but also hampers the handling of the individually formed shaped bodies, e.g., the brick, since injuries may result.

From European Patent 0 515 704 B1, a device is known to notch extruded pieces, in which extruded pieces are first pushed transverse to their longitudinal direction into a notching device that has rows of notched rollers that can move transversely to the direction of movement of the clay column. The notching device consists of an upper and a lower notched roller holder that holds an extruded piece between the holders with rows of notched rollers attached to the holders in pairs in each case. Thus, the rows of notched rollers have a first position relative to one another that leads to notching of the lower and upper sides of the extruded piece. From that first position, the notched rollers are moved toward one another to a second position while acting on the upper side and back side of the extruded piece in the direction of the center of the extruded piece. The extruded piece is raised with an elevating platform adjacent the notched roller pair into the second position, whereby the notched extruded piece is forced through a wire fan and is cut to the length of the shaped body. However, this prior patented device is very expensive and difficult to adjust to various dimensions of extruded pieces or shaped bodies.

DISCLOSURE OF THE INVENTION

An object of the present invention is therefore to provide a device with which the development of a cutting ridge, or deformation of the material forming the body and the notch and any resultant ridges, are prevented when a notched extruded piece is cut with wires that are guided in a direction toward a side of the shaped body.

The advantages that can be achieved with the invention lie particularly in the fact that the brick-shaped bodies are not deformed during cutting, no undesirable ridge is left at the cut edge, and the definition of the notch remains as prior to cutting.

Another advantage is that a commonly used cutting device with a conveyor belt and a notching device that is arranged upstream can be retrofitted as a cutting device according to the invention for implementing the process according to this invention. The invention can thus be designed in a simple way.

According to an advantageous further development of the invention, support strips can be arranged relative to fixed seating strips in such a way that they can be raised and lowered or, conversely, the seating strips can be arranged in such a way that they can be raised or lowered relative to fixed support strips.

In a preferred embodiment according to the present invention, there is provided a process for cutting a body of material provided with at least one notch along one side of the body through which a cut is to be made to form individual shaped bodies, comprising the step of engaging supports with material forming one notch on opposite sides of the cut to be made so that during cutting, the body of material is supported and deformation of the material of the body forming the notch is substantially precluded.

In a further preferred embodiment according to the present invention, there is provided apparatus for supporting a body of material having at least one notch along one side thereof through which a cut is to be made to form individual shaped bodies, comprising a pair of seating strips for supporting the deformable body prior to cutting and on opposite sides of the notch, a pair of supports between the pair of seating strips for engaging material forming the notch on a same side of the seating strips as the body, the supports being spaced from one another to enable a cutting wire to pass between the supports during cutting of the body into the individually shaped bodies.

In a still further preferred embodiment according to the present invention, there is provided apparatus for supporting a body of material having a plurality of notches extending parallel to and spaced from one another through which cuts are to be made to form individual shaped bodies, comprising a plurality of seating strips for supporting the body prior to cutting, with each seating strip lying between an adjacent pair of notches and a pair of supports straddling each seating strip for engaging within and material forming respective portions of the next-adjacent notches, respectively, for supporting the notch portions during cutting to preclude deformation of the material of the body forming the notch.

BEST MODE FOR CARRYING OUT THE INVENTION

Figure 3:
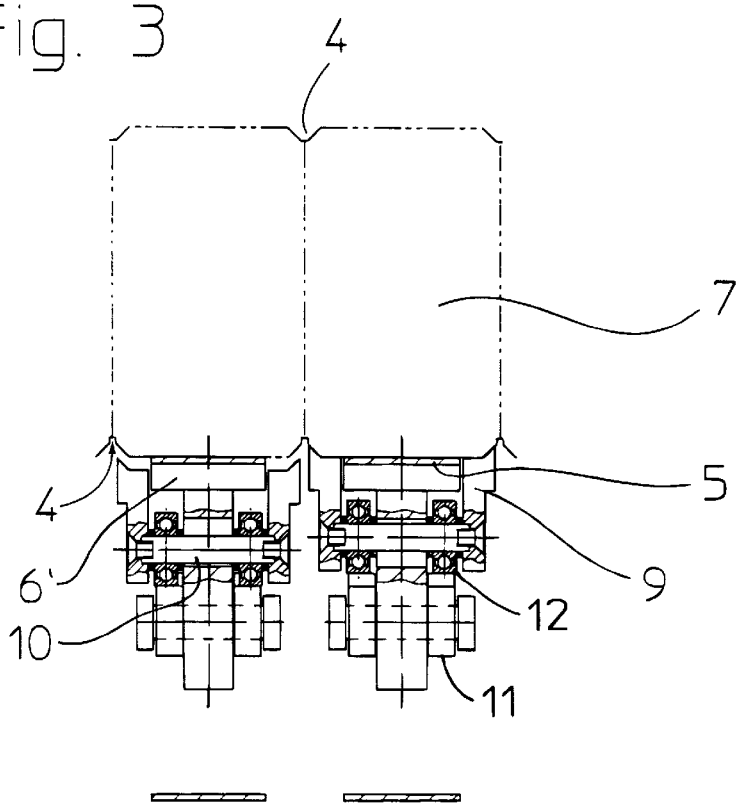
FIG. 3 is a partial cross-sectional view of the cutting device according to the invention in the longitudinal direction of the body of material to be cut, e.g., the clay column.

A deformable body 1, e.g., an extruded clay column section that is to be cut into individual shaped bodies 7 is first provided with circumferential notches 4 at the edges of the body to be cut. The notches 4 are provided in the body 1 prior to cutting body 1 into individual shaped bodies 7 by means of an edge-notching device as is described in, for example, Patent DE 33 06 852. The extruded section 1 is then brought into a cutting position by a conveying device 2, by which the extruded section is disposed on a cutting table that consists of individual conveyor belts 5. As best shown in FIG. 3, and to brace against the cutting pressure, conveyor belts 5 are supported in the cutting area by seating strips 6'. As illustrated, the sets of belts 5 and seating strips 6' are located some distance apart so that a cutting wire 3 can extend through body 1 and notches 4 and between the sets of belts and seating strips to divide extruded piece 1 into individual shaped bodies 7.

Figure 2:
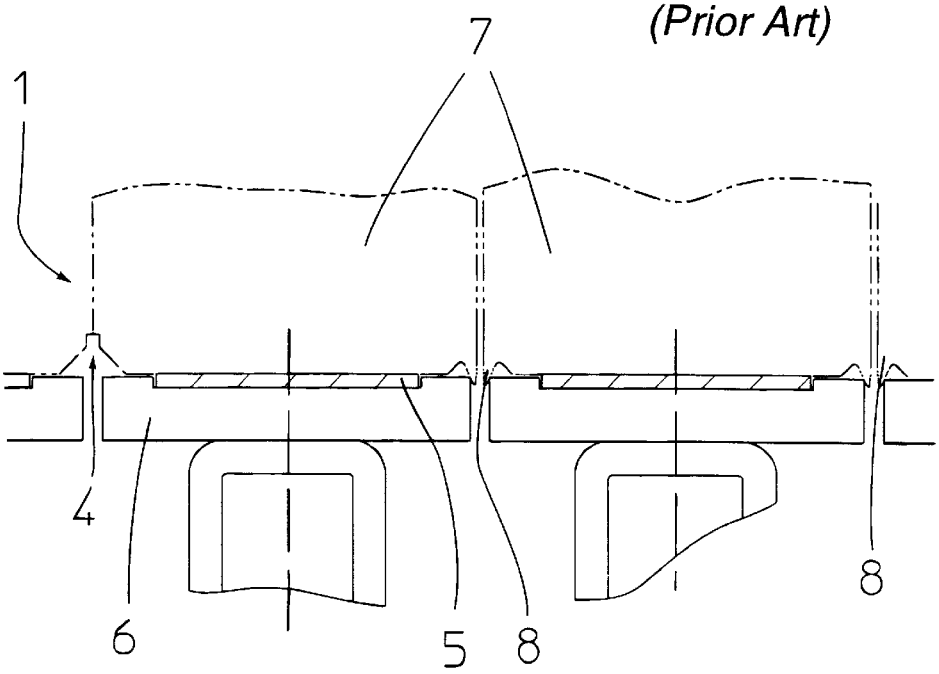
Fig. 2 (Prior Art)
FIG. 2 is a partial cross-sectional view of a conventional cutting device taken in the longitudinal direction of the clay column.

In contrast to the prior art illustrated in FIG. 2, seating strips 6 project laterally beyond conveyor belts 5. However, in the embodiment of the clay column cutting device according to the present invention (see FIG. 3), seating strips 6' are placed only below conveyor belts 5. In addition, supports or support strips 9, which can be raised and lowered, are arranged on both sides of seating strips 6'. The raised or upwardly bent ends of the supports may engage in and contact portions of the material of body 1 forming notches 4. At a notch 4, two adjacent support strips 9 are spaced from one another and arranged in such a way that the cutting wire 3 can slice between them. Deformation of extruded piece 1, such as occurs in the prior art and is indicated in FIG. 2, as irregular or distorted edges 8 at the notches are avoided because supports 9 engage and brace the notch along both sides thereof.

Figure 1:
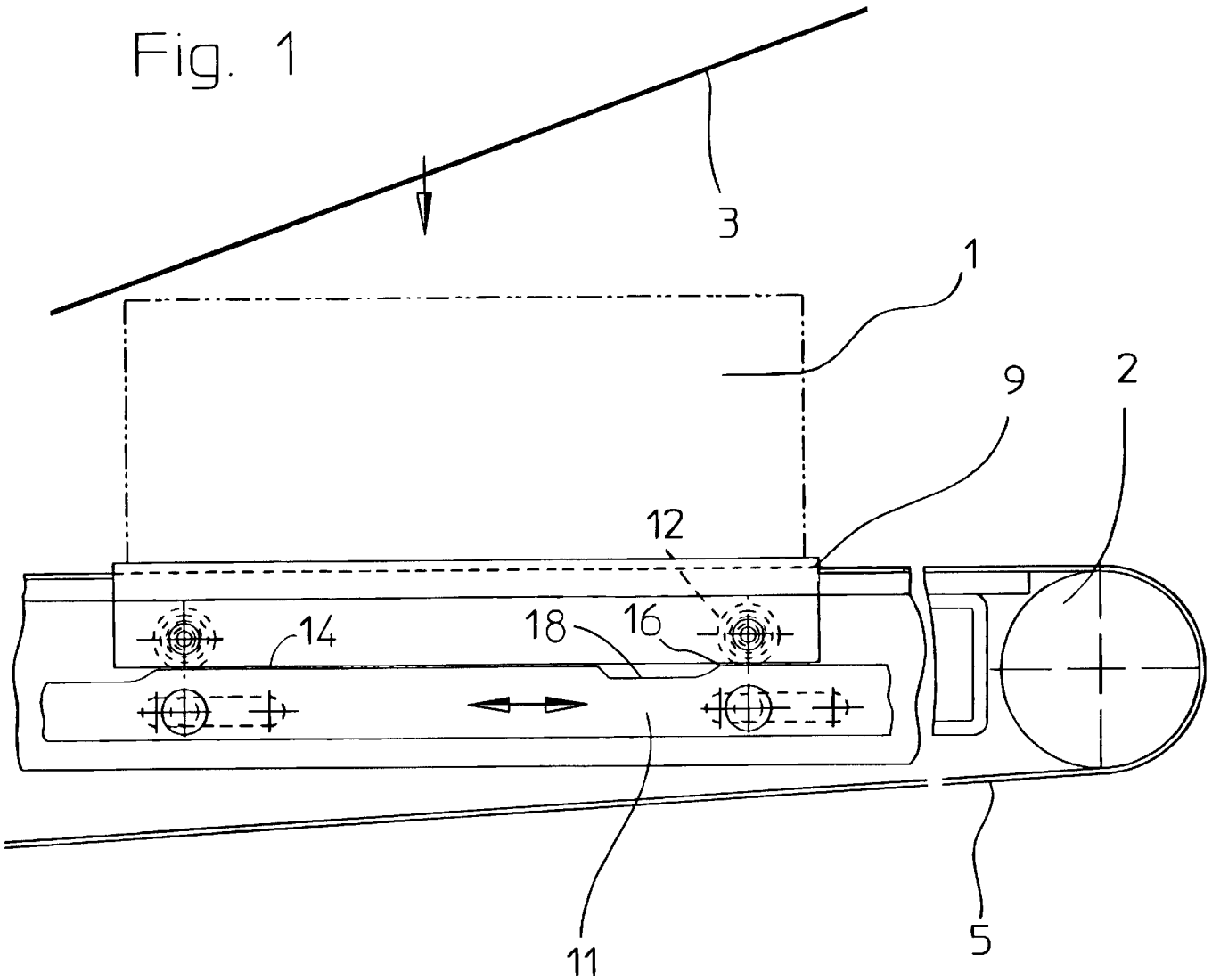
FIG. 1 is a fragmentary cross-sectional view of a device in a cutting position transverse to the direction of the clay column.

Support strips 9 are raised to engage within notches 4 during the cutting process and thereby support clay column 1 and the material of body 1 defining notches 4. The supports 9 can be lowered again before cutting to feed the clay column and after cutting to transport the shaped bodies. In a preferred embodiment of the invention, the raising and lowering process is accomplished via a movable support 11 (FIG. 1). Connecting pins 10 connect two support strips 9 on opposite sides of seating strip 6' and which two support strips are associated with a single shaped body 7. The pins mount cam wheels 12 which engage along an upper surface 14 of support 11 and which surface 14 includes raised and lowered cam follower surfaces 16 and 18, respectively. Thus, by longitudinally displacing movable support 11, the wheels 12 engage the raised or lowered cam follower surfaces 16, 18 to raise or lower the supports 6', respectively.

As an alternative, the support strips 9 may be fixed and the seating strips 6' may be raised and lowered by a similar mechanism.

With the process and apparatus according to the present invention, it is thus possible to cut a deformable body 1, e.g., a clay column into individual brick-shaped bodies, without deformation of the extruded material of the body and without undesirable irregularities along the cut edges in the areas of the notches.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for cuffing a body of material comprised of deformable clay provided with at least one notch along one side of the body through which a cut is to be made along a at line to form individual shaped bodies, comprising the steps of:

engaging supports in said at least one notch on opposite sides of the cut line and supporting the deformable clay material forming the notch on opposite sides of the cut line when cutting through the notch so that during cutting, the body of deformable clay material is supported and deformation of the deformable clay material forming the notch is substantially precluded, and cuffing the body of deformable clay material including cutting along the cut line through said at least one notch while said supports engage in said at least one notch to form the individually shaped bodies.

2. A process according to claim 1 wherein the step of engaging includes relatively moving said body of deformable clay material and said supports into engagement with one another prior to cutting through said one notch such that the supports and the deformable clay material forming the notch are engaged with on another.

3. A process according to claim 1 wherein the body of deformable clay material has a plurality of spaced, generally parallel notches extending along said one body side, seating strips engage the individual shaped bodies between said notches and a conveyor belt overlies each seating strip for conveying the body of deformable clay material in a first direction into a position to register said notches and said supports with one another, respectively, wherein the step of engaging includes relatively moving said body of deformable clay material and said supports into engagement with one another in a direction generally normal to said first direction prior to cutting through said one notch such that the supports and the deformable clay material forming the notches are engaged.

4. A process according to claim 3 wherein the step of relatively moving the body of deformable clay material and the supports includes displacing said supports toward said body of deformable clay material while maintaining the body of deformable clay material from movement in said normal direction.

5. A process for cutting a body of material comprised of deformable clay having a plurality of spaced, generally parallel notches extending along one side of the body through which cuts are to be made along respective cut lines to form individual shaped bodies comprising the steps of:

supporting the body of material comprised of deformable clay on seating strips extending between said notches along said one body side;

engaging supports located on the opposite sides of each said seating strip in portions of the notches on opposite sides of the cut lines corresponding to each said individual shaped body supported by said seating strip so that during cutting, the body of deformable clay material is supported at the notch portions and deformation of the deformable clay material forming the notch is substantially precluded; and cutting the body of deformable clay material including cutting along the cut lines through said notches while said supports engage in said notch portions to form the individual shaped bodies.

6. A process according to claim 5 wherein the step of engaging includes relatively moving said body of deformable clay material and said supports into engagement with one another prior to cutting through said notches such that the supports and the deformable clay material forming the notches are engaged with one another.

7. A process according to claim 5 including moving said seating strips and said supports relative to one another to locate said supports on the same side of said seating strips as said body of deformable clay material to engage in said notches, and including the further step of moving said seating strips and said supports relative to one another to locate said supports on an opposite side of said seating strips from said body of deformable clay material to space the supports from the notches.

8. A process according to claim 7 including a conveyor belt overlying each seating strip, and conveying the body of deformable clay material on the conveyor belt in a direction normal to a direction of relative movement of said seating strips and said supports, enabling conveyance of the body in said normal direction when said supports are located on said opposite side of said seating strips and spaced from the notches.

* * * * *